US007837534B2

(12) United States Patent
Aiyoshizawa et al.

(10) Patent No.: US 7,837,534 B2
(45) Date of Patent: Nov. 23, 2010

(54) APPARATUS FOR HEATING OR COOLING A POLISHING SURFACE OF A POLISHING APPARATUS

(75) Inventors: Shunichi Aiyoshizawa, Tokyo (JP); Ryuichi Kosuge, Tokyo (JP); Ryo Kato, Tokyo (JP); Yu Ishii, Tokyo (JP)

(73) Assignee: Ebara Corporation, Tokyo (JP)

( * ) Notice: Subject to any disclaimer, the term of this patent is extended or adjusted under 35 U.S.C. 154(b) by 398 days.

(21) Appl. No.: 12/155,618

(22) Filed: Jun. 6, 2008

(65) Prior Publication Data

US 2008/0311823 A1 Dec. 18, 2008

(30) Foreign Application Priority Data

Jun. 13, 2007 (JP) ..... 2007-156851

(51) Int. Cl.
*B24B 49/00* (2006.01)

(52) U.S. Cl. ..... 451/7; 451/53; 451/287

(58) Field of Classification Search ..... 451/7, 451/36, 41, 53, 285, 287, 288
See application file for complete search history.

(56) References Cited

U.S. PATENT DOCUMENTS

| | | | | |
|---|---|---|---|---|
| 4,313,284 | A * | 2/1982 | Walsh | 451/288 |
| 4,450,652 | A * | 5/1984 | Walsh | 451/7 |
| 5,127,196 | A * | 7/1992 | Morimoto et al. | 451/7 |
| 5,775,980 | A * | 7/1998 | Sasaki et al. | 451/285 |
| 6,012,967 | A * | 1/2000 | Satake et al. | 451/36 |
| 6,422,921 | B1 * | 7/2002 | Ettinger | 451/41 |
| 6,749,484 | B2 * | 6/2004 | Yang et al. | 451/7 |
| 6,837,773 | B2 * | 1/2005 | Brunelli | 451/7 |
| 6,896,586 | B2 * | 5/2005 | Pham et al. | 451/7 |
| 7,201,634 | B1 * | 4/2007 | Naujok et al. | 451/7 |
| 2002/0009953 | A1 * | 1/2002 | Swanson | 451/53 |
| 2003/0104769 | A1 * | 6/2003 | Brunelli | 451/53 |
| 2003/0114077 | A1 * | 6/2003 | Yang et al. | 451/7 |
| 2003/0119427 | A1 * | 6/2003 | Misra | 451/41 |
| 2003/0186623 | A1 * | 10/2003 | Pham et al. | 451/7 |
| 2007/0054599 | A1 * | 3/2007 | Taylor et al. | 451/6 |
| 2009/0061745 | A1 * | 3/2009 | Heinrich et al. | 451/289 |
| 2010/0035515 | A1 * | 2/2010 | Marks et al. | 451/5 |
| 2010/0062691 | A1 * | 3/2010 | Togawa et al. | 451/53 |

FOREIGN PATENT DOCUMENTS

| | | |
|---|---|---|
| JP | 11-347935 | 12/1999 |
| JP | 2001-062706 | 3/2001 |
| JP | 2005-040920 | 2/2005 |

* cited by examiner

*Primary Examiner*—Eileen P. Morgan
(74) *Attorney, Agent, or Firm*—Wenderoth, Lind & Ponack, L.L.P.

(57) ABSTRACT

The present invention provides an apparatus for heating or cooling a polishing surface. This apparatus includes a heat exchanger arranged so as to face the polishing surface when the workpiece is polished. The heat exchanger includes a medium passage through which a heat-exchanging medium flows, and a bottom surface facing the polishing surface. At least a part of the bottom surface is inclined with an upward gradient above the polishing surface such that a polishing liquid on the polishing surface generates a lift exerted on the bottom surface during movement of the polishing surface.

8 Claims, 15 Drawing Sheets

APPARATUS FOR HEATING OR COOLING A POLISHING SURFACE OF A POLISHING APPARATUS

BACKGROUND OF THE INVENTION

1. Field of the Invention

The present invention relates to an apparatus capable of heating or cooling a polishing surface of a polishing pad or fixed abrasive of a polishing apparatus for use in polishing various workpiece, such as a semiconductor wafer, various types of hard disk, a glass substrate, a liquid crystal panel, or the like.

2. Description of the Related Art

A CMP (Chemical Mechanical Polishing) apparatus has been used in fabrication processes of a semiconductor integrated circuit device. The CMP apparatus typically includes a holding mechanism for holding a semiconductor wafer (an object to be polished), and a rotatable table with a polishing pad or fixed abrasive attached thereto. The apparatus of this type is operable such that the holding mechanism presses the semiconductor wafer against a polishing surface of the polishing pad or fixed abrasive on the rotating table, while supplying a polishing liquid, e.g., slurry, onto the polishing surface. The semiconductor wafer is polished by relative movement between the polishing pad or fixed abrasive and the semiconductor wafer.

When the polishing apparatus having the above-mentioned structures performs polishing of a semiconductor wafer, the surface of the polishing pad (or fixed abrasive) may be deformed due to frictional heat, or a polishing performance may be lowered due to a variation in polishing capability caused by a temperature distribution over the polishing surface of the polishing pad (or fixed abrasive). Therefore, it is necessary to cool the polishing surface so as to keep the polishing surface within a predetermined temperature range.

An example of a method of cooling the polishing surface is shown in FIG. 1. A cooling-medium passage 102 is provided in a table 101, so that a cooling medium, such as cooling water, flows through the cooling-medium passage 102 to thereby cool a polishing pad 103 attached to an upper surface of the table 101. Rotation of a shaft 104 causes the table 101 to rotate together with the polishing pad 103. During rotation of the polishing pad 103, a polishing liquid 106, such as slurry, is supplied from a supply nozzle 105 onto an upper surface of the polishing pad 103, and a substrate holding mechanism 107, such as a top ring, presses a semiconductor wafer 108 against the upper surface of the polishing pad 103 while rotating the semiconductor wafer 108. In this manner, the semiconductor wafer 108 is polished by relative movement (i.e., sliding contact) between the polishing pad 103 and the semiconductor wafer 108.

In the above-described polishing apparatus, friction between the semiconductor wafer 108 and the polishing pad 103 generates heat Q, which radiates as atmospheric radiant heat Q1, polishing-liquid radiant heat Q2, and cooling-medium radiant heat Q3. The atmospheric radiant heat Q1 is heat radiating from the surface of the polishing pad 103, the polishing-liquid radiant heat Q2 is heat radiating into the polishing liquid 106, and the cooling-medium radiant heat Q3 is heat radiating into the cooling medium in the cooling-medium passage 102. These heat radiations allow the polishing surface of the polishing pad 103 to maintain its temperature within a certain range. For example, experimental results confirmed that a surface temperature of the polishing pad 103 was 65° C. under conditions that the heat Q generated by polishing was 1900 W and an atmospheric temperature was 23° C. The heat Q radiated as the atmospheric radiant heat Q1 (=600 W), the polishing-liquid radiant heat Q2 (=600 W), and the cooling-medium radiant heat Q3 (=700 W). These results were obtained by measurements and calculations, which confirmed heat balance.

However, when the surface temperature of the polishing pad 103 is 65° C., efficient polishing may not be performed. To increase a polishing rate (removal rate), there is a need to lower the surface temperature of the polishing pad 103 to 45° C. Generally, heat release is proportional to a temperature difference. The temperature difference between the polishing-pad surface temperature 45° C. and the atmospheric temperature 23° C. is 22° C. In this case, the atmospheric radiant heat Q1 is 300 W, the polishing-liquid radiant heat Q2 is 300 W, the cooling-medium radiant heat Q3 is 350 W, and accordingly, the total heat (Q1+Q2+Q3) is 950 W. This means that an additional heat-radiation means is required in order to release the heat by nearly 1000 W.

One example of such a means for heat radiation is to provide the above-described cooling-medium passage 102 in the table 101. The polishing pad 103 on the upper surface of the table 101 is cooled by the cooling medium, e.g., cooling water, flowing through the cooling-medium passage 102. However, the polishing pad 103 typically uses a low heat conductive material, such as foamed urethane. Therefore, cooling from a back surface (lower surface) could not result in sufficient heat radiation from the front surface (upper surface), and it is difficult to lower the temperature to less than 65° C.

Japanese laid-open patent publication No. 11-347935 discloses another approach in which a jet of cooling gas, e.g., a cooled $N_2$, is supplied from a nozzle to an upper surface of a polishing pad to cool it. This approach, however, has drawbacks for the following reasons. In this method, a jet of gas is supplied to the upper surface of the polishing pad, while polishing is performed. The jet of gas could dry the upper surface (i.e., polishing surface) to cause scratching of a surface of a workpiece due to compositions in a polishing liquid (e.g., slurry) or due to particles removed from the workpiece.

The aforementioned patent publication also discloses supply of a cooling liquid, e.g., pure water, from a nozzle onto the upper surface of the polishing pad to cool it. However, the cooling liquid would dilute the polishing liquid on the polishing surface of the polishing pad, causing a change in polishing conditions and unstable polishing rates.

The above patent publication further discloses providing a heat exchange member on the upper surface of the polishing pad so that a cooling medium is supplied from a supply device to the heat exchange member to directly cool the upper surface of the polishing pad. This method can effectively cool the upper surface of the polishing pad and can improve a cooling efficiency. However, since the heat exchange member is in direct contact with the upper surface of the polishing pad, the heat exchange member and the polishing pad could be worn.

SUMMARY OF THE INVENTION

The present invention has been made in view of the above drawbacks. An object of the present invention is to provide an apparatus for heating or cooling a polishing surface of a polishing pad or fixed abrasive on a table of a polishing apparatus during polishing of a workpiece.

One aspect of the present invention for achieving the above object is to provide an apparatus for heating or cooling a polishing surface of a polishing apparatus operable to polish a workpiece by sliding contact between the workpiece and the polishing surface while supplying a polishing liquid onto the polishing surface. The apparatus for heating or cooling the polishing surface includes a heat exchanger arranged so as to face the polishing surface when the workpiece is polished. The heat exchanger includes a medium passage through which a heat-exchanging medium flows, and a bottom surface facing the polishing surface. At least a part of the bottom surface is inclined with an upward gradient above the polishing surface such that the polishing liquid, which is present between the polishing surface and the bottom surface, generates a lift exerted on the bottom surface during movement of the polishing surface.

In a preferred aspect of the present invention, the at least a part of the bottom surface comprises a linearly inclined surface.

In a preferred aspect of the present invention, the at least a part of the bottom surface comprises steps.

In a preferred aspect of the present invention, the heat exchanger is operable to perform heat exchange between the polishing surface and the heat-exchanging medium flowing through the medium passage, during polishing of the workpiece.

According to the present invention, during polishing the workpiece, the polishing liquid on the polishing surface flows into a gap between the inclined bottom surface of the heat exchanger and the polishing surface to generate a lift due to wedge action. This lift is exerted on the heat exchanger to reduce friction between the bottom surface and the polishing surface. Consequently, less wear occurs and less frictional heat is generated, compared with a conventional structure having no inclined bottom surface. Further, damage to the polishing surface can be reduced.

During polishing, the heat exchange is performed between the polishing surface and the heat-exchanging medium flowing through the medium passage. As a result, the polishing surface is cooled or heated to a temperature suitable for polishing of the workpiece, so that the workpiece can be polished at a stable polishing rate (removal rate).

In a preferred aspect of the present invention, the heat exchanger further includes plural elongated protrusions arranged on the bottom surface at predetermined intervals. The elongated protrusions form a path therebetween for the polishing liquid.

Because the path of the polishing liquid is formed between the elongated protrusions on the bottom surface, the polishing liquid, flowing through the path, can exert the stable lift on the heat exchanger. Therefore, the heat exchanger can keep its stable attitude, with keeping out of contact with the polishing surface. Hence, stable heat exchange can be performed between the polishing surface and the heat-exchange medium, so that the polishing surface can be cooled or heated.

In a preferred aspect of the present invention, the apparatus further includes a heat-exchanger holding mechanism having a pressing mechanism configured to press the heat exchanger against the polishing surface.

A balance between the pressing force of the pressing mechanism and the lift exerted by the wedge action of the polishing liquid can allow the heat exchanger to stay in a suitable position, with the bottom surface thereof being away from the polishing surface.

In a preferred aspect of the present invention, the heat exchanger is made from SiC.

Because SiC has a high heat conductivity, heat exchange between the polishing surface and the medium can be efficiently performed. Therefore, the temperature of the polishing surface can be easily adjusted. In addition, because SiC has an excellent wear resistance and a low specific gravity, the heat exchanger can be lightweight. Further, use of SiC does not arise a problem of metal contamination to the workpiece, such as a semiconductor wafer.

In a preferred aspect of the present invention, the heat-exchange medium comprises cooling water.

DETAILED DESCRIPTION OF THE PREFERRED EMBODIMENTS

Figure 1:
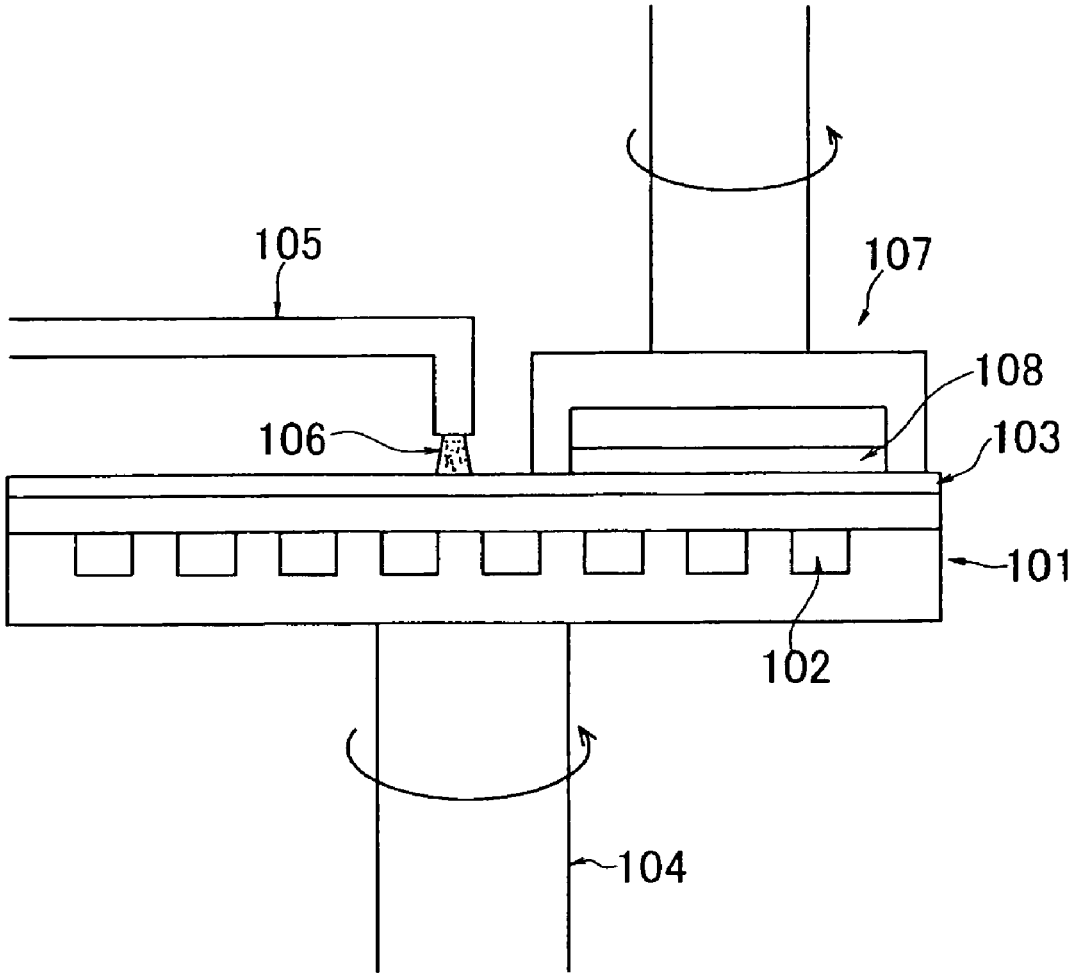
FIG. 1 is a schematic view showing a conventional polishing apparatus.
Figure 2:
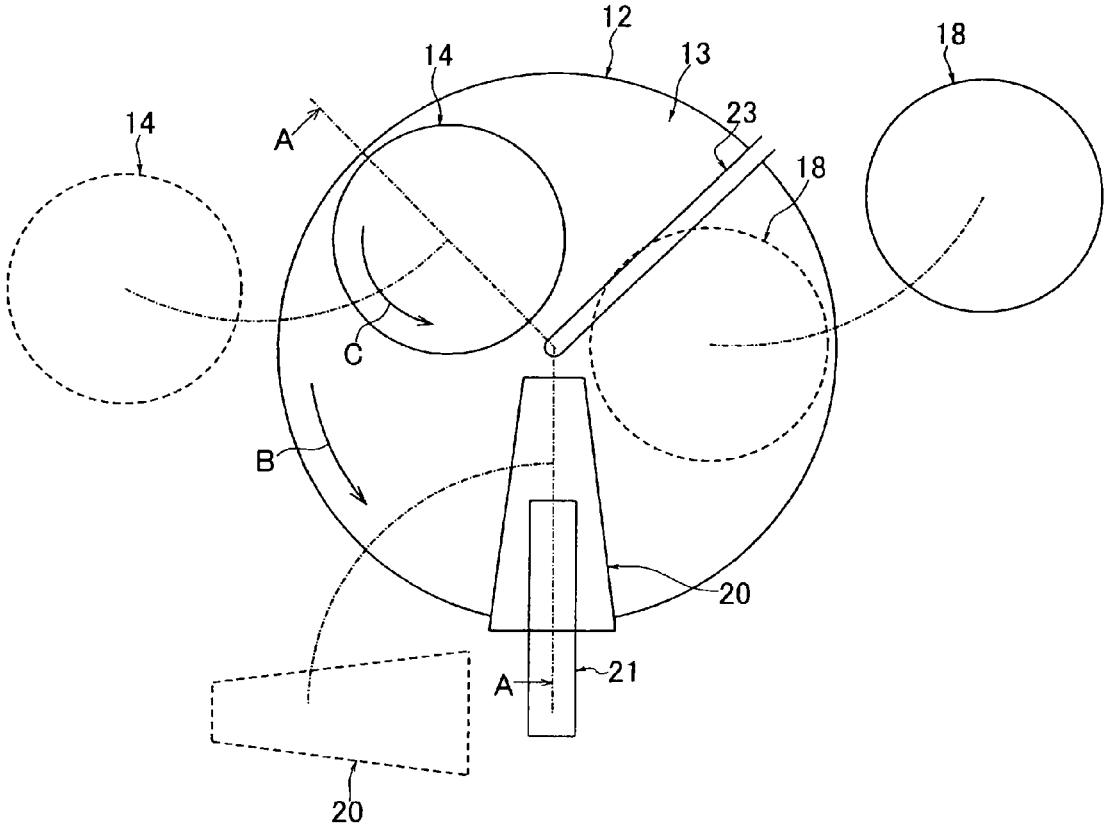
FIG. 2 is a plan view showing a schematic structure of a polishing apparatus with an apparatus for heating or cooling a polishing surface according to an embodiment of the present invention.
Figure 3:
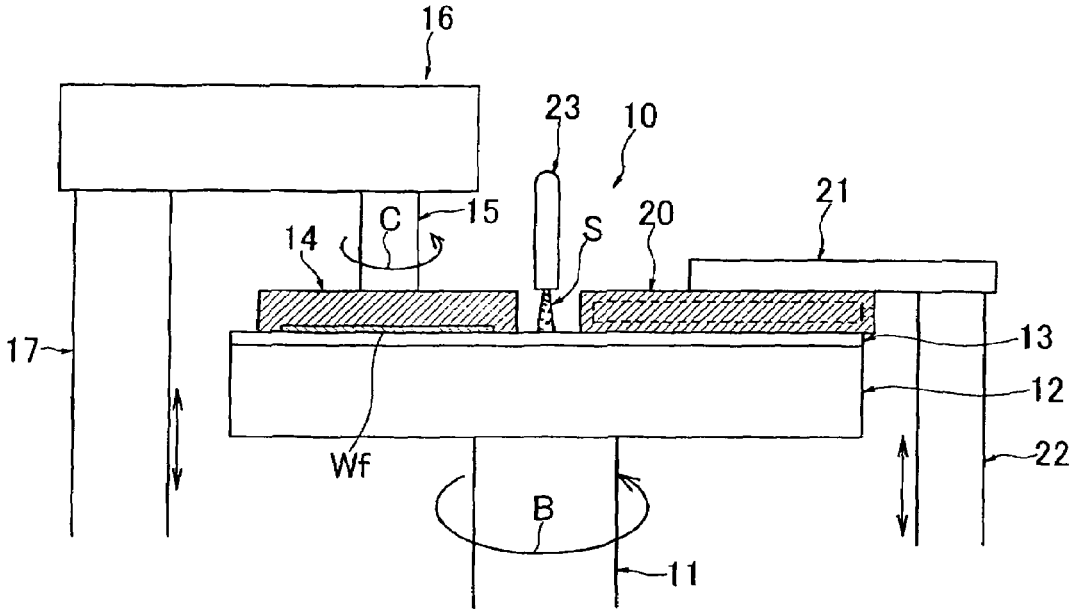
FIG. 3 is a cross-sectional view taken along line A-A in FIG. 2.

Embodiments of the present invention will be described below with reference to the drawings. FIG. 2 is a plan view showing a schematic structure of a polishing apparatus having an apparatus for heating or cooling a polishing surface according to an embodiment of the present invention. FIG. 3 is a cross-sectional view taken along line A-A in FIG. 2. The polishing apparatus 10 comprises a table 12 rotatable about a rotational shaft 11. A polishing pad 13 is attached to an upper surface of the table 12. Reference numeral 14 represents a workpiece-holding mechanism configured to hold a semiconductor wafer Wf, i.e., a workpiece to be polished. This workpiece-holding mechanism 14 is rotatably coupled to a holding-mechanism arm 16 via a rotational shaft 15. The holding-mechanism arm 16 has a rear end fixed to a swing shaft 17. Rotation of the swing shaft 17 allows the workpiece-holding mechanism 14 to move between a polishing position above the table 12 and a waiting position outwardly of the table 12. In FIG. 2, the polishing position is shown with solid line, and the waiting position is shown with dotted line.

Reference numeral 18 represents a dresser configured to dress a polishing surface (upper surface) of the polishing pad 13. This dresser 18 is rotatably coupled to a dresser arm (not shown) via a rotational shaft (not shown), as with the workpiece-holding mechanism 14. The dresser 18 has a rear end fixed to a swing shaft (not shown). Rotation of this swing shaft allows the dresser 18 to move between a dressing position above the table 12 and a waiting position outwardly of the table 12. In FIG. 2, the dressing position is shown with dotted line, and the waiting position is shown with solid line.

Reference numeral 20 represents a heat exchanger configured to cool the polishing surface of the polishing pad 13 attached to the upper surface of the table 12. This heat exchanger 20 is coupled to a support arm 21 via a support mechanism, which will be discussed later. The support arm 21 has a rear end fixed to a swing shaft 22. Rotation of this swing shaft 22 allows the heat exchanger 20 to move between a cooling position above the table 12 and a waiting position outwardly of the table 12. In FIG. 2, the cooling position is shown with solid line, and the waiting position is shown with dotted line. Reference numeral 23 represents a polishing-liquid supply nozzle 23 configured to supply slurry S (i.e., a polishing liquid) onto a center of the upper surface of the polishing pad 13.

The polishing apparatus having the above-mentioned structures operates as follows. The rotational shaft 11 rotates in a direction as indicated by arrow B to cause the table 12 to rotate in the same direction. The workpiece-holding mechanism 14 holds the semiconductor wafer (workpiece) Wf, and the rotational shaft 15 rotates in a direction as indicated by arrow C to cause the semiconductor wafer Wf to rotate in the same direction. The workpiece-holding mechanism 14 then presses the semiconductor wafer Wf against the polishing surface of the polishing pad 13 on the table 12, while the polishing-liquid supply nozzle 23 supplies the slurry S onto the polishing surface of the polishing pad 13. The semiconductor wafer Wf is thus polished by relative movement (i.e., sliding contact) between the polishing pad 13 and the semiconductor wafer Wf During polishing, frictional heat is generated, increasing a temperature of the polishing pad 13. Thus, the heat exchanger 20 is brought into contact with the polishing surface of the polishing pad 13 so as to cool the polishing surface, whereby the temperature of the polishing surface falls within a temperature range (specifically, not more than 45° C.) suitable for polishing the semiconductor wafer Wf.

Figure 4:
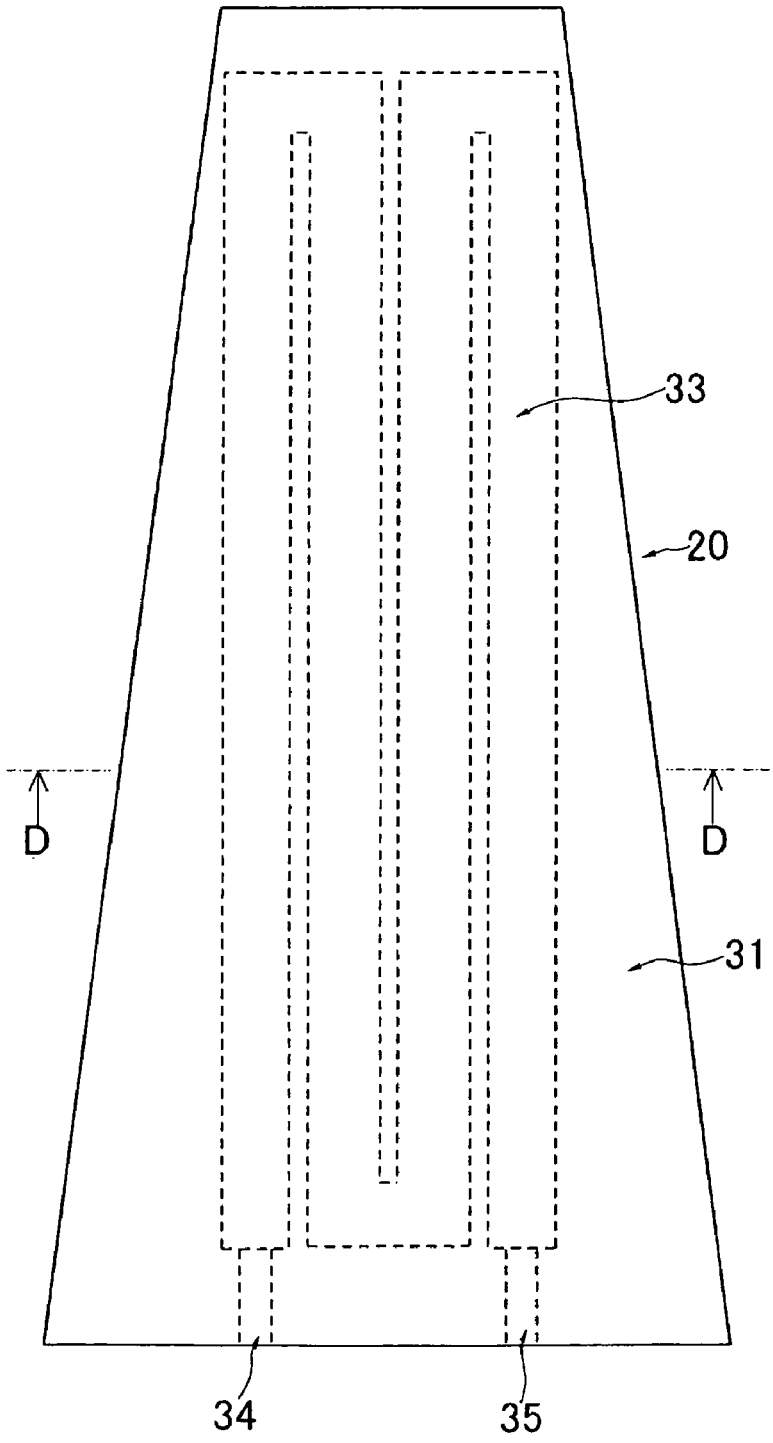
FIG. 4 is a plan view showing an appearance of a heat exchanger.
Figure 5:
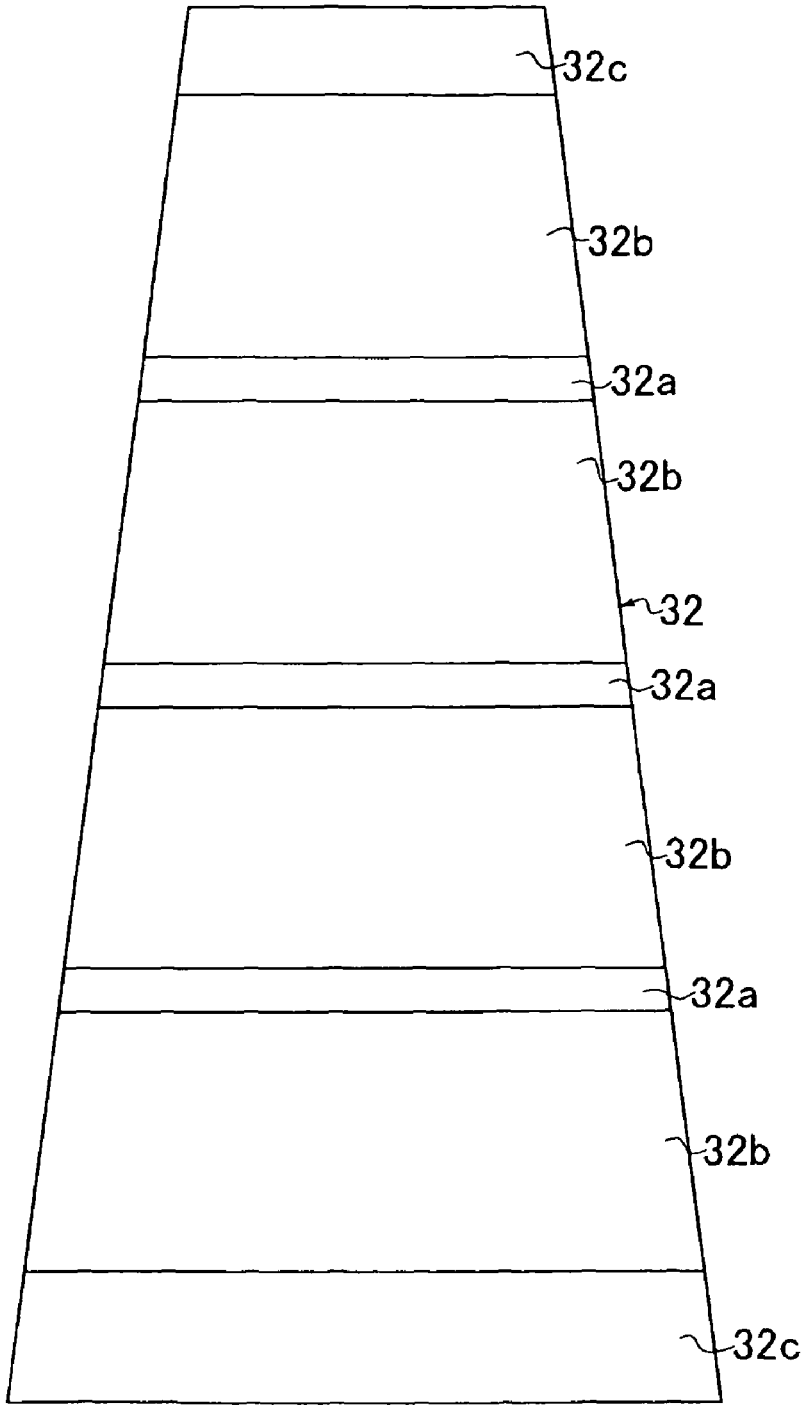
FIG. 5 is a bottom view showing an appearance of the heat exchanger.
Figure 6:
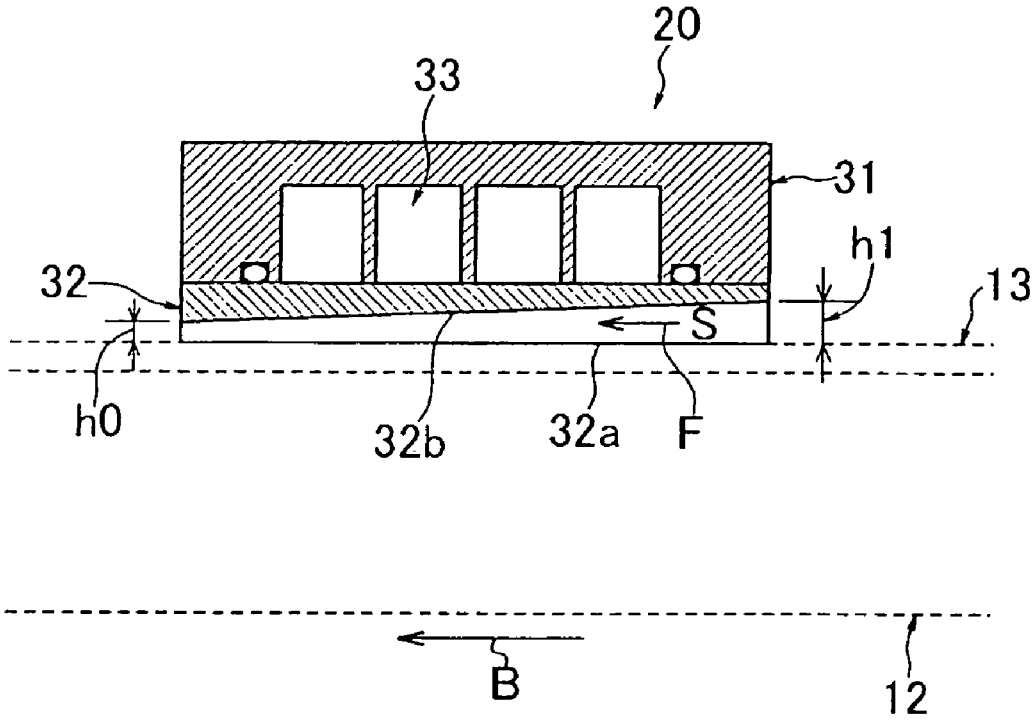
FIG. 6 is a cross-sectional view taken along line D-D in FIG. 4.

FIG. 4 and FIG. 5 are views each showing an appearance of the heat exchanger 20. Specifically, FIG. 4 is a plan view of the heat exchanger, and FIG. 5 is a bottom view of the heat exchanger. FIG. 6 is a cross-sectional view taken along line D-D in FIG. 4, and shows internal structures of the heat exchanger. As shown in the drawings, the heat exchanger 20 is of an elongated trapezoid shape having a narrow end (an end close to a center of the table 12) and a wide end (an end located outwardly of the table 12). This heat exchanger 20 comprises a heat-exchange body 31 and a bottom plate 32 under the heat-exchange body 31. The heat-exchange body 31 has a zigzag medium passage 33 therein through which cooling water (a cooling medium) flows. This medium passage 33 has end openings communicating with a medium inlet 34 and a medium outlet 35, respectively.

The bottom plate 32 has a bottom surface comprising inclined bottom surfaces 32*b* each facing the polishing pad 13. These bottom surfaces 32*b* lie with an upward gradient at a predetermined angle above the polishing surface so as to counter a movement direction of the table 12 (or movement direction of the polishing pad 13 as indicated by arrow B in FIG. 6). Specifically, the bottom surfaces 32*b* are directed upwardly along a direction opposite to the movement direction of the polishing surface. Elongated protrusions 32*c* are provided on both ends of the bottom surface of the bottom plate 32. Between these elongated protrusions 32*c*, plural (three in the drawing) elongated protrusions 32*a* are provided at predetermined intervals. A gap between the elongated protrusion 32*c* and the elongated protrusion 32*a* and a gap between the elongated protrusion 32*a* and the protrusion 32*a* provide paths for the slurry S on the polishing surface of the polishing pad 13, so that the slurry S flows into these paths by the rotation of the polishing pad 13. The protrusions 32*a* and the protrusions 32*c* have lower ends (top portions) that lie in the same horizontal plane so that all top surfaces of these lower ends come into contact with the polishing surface of the polishing pad 13.

Figure 7:
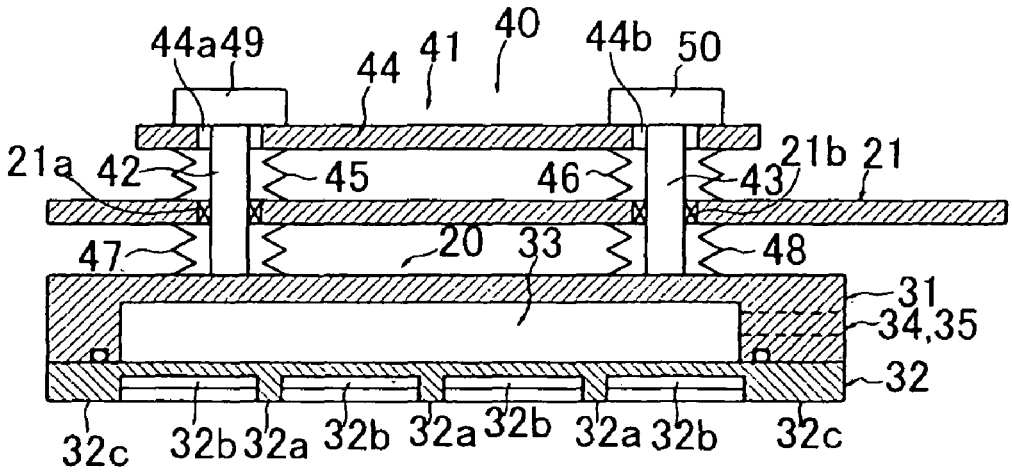
FIG. 7 is a front cross-sectional view showing the heat exchanger held by a heat-exchanger holding mechanism.

FIG. 7 is a front cross-sectional view showing the heat exchanger 20 held by a heat-exchanger holding mechanism. A heat-exchanger holding mechanism 40 includes a support mechanism 41 and the support arm 21. The heat exchanger 20 is coupled to the support arm 21 via the support mechanism 41. This support mechanism 41 has support pins 42 and 43, a plate 44, and springs 45-48. The support pins 42 and 43 are attached to the heat-exchange body 31 of the heat exchanger 20. The plate 44 is located above the heat-exchange body 31. The support pins 42 and 43 are arranged on an upper portion of the heat-exchange body 31 at predetermined intervals, and are supported by bearings 21*a* and 21*b* mounted on the support arm 21. The bearings 21*a* and 21*b* slidably support the support pins 42 and 43 so as to allow the support pins 42 and 43 to move axially. The support pins 42 and 43 extend through through-holes 44*a* and 44*b* formed in the plate 44. Disk-shaped stoppers 49 and 50 are attached respectively to upper ends of the support pins 42 and 43. The stoppers 49 and 50 have a diameter larger than a diameter of the through-holes 44*a* and 44*b* of the plate 44. It is preferable that self-lubricating bearings be used as the bearings 21*a* and 21*b*.

The springs 45 and 46 are located between the plate 44 and the support arm 21 so as to press the plate 44 in a direction away from the support arm 21. The springs 47 and 48 are located between the heat-exchange body 31 and the support arm 21 so as to press the heat-exchange body 31 in a direction away from the support arm 21. With these arrangements, the stoppers 49 and 50 are placed in contact with the plate 44, so that the support pins 42 and 43 do not come off the through-holes 44*a* and 44*b* of the plate 44. The heat exchanger 20 is elastically coupled to the support arm 21 via an elastic force of the springs 45 and 46 and an elastic force of the springs 47 and 48. Therefore, rotation of the swing shaft 22 (see FIG. 3) can allow the heat exchanger 20 to move from the waiting position (as indicated by the dotted line in FIG. 2) to the position above the table 12 (as indicated by the solid line in FIG. 2), and then a downward movement of the swing shaft 22 brings the bottom surface of the heat exchanger 20 into contact with upper surface of the polishing pad 13, so that the heat exchanger 20 presses the polishing surface at a predetermined force.

The above-described structures of the heat-exchanger holding mechanism 40 are an example. The heat-exchanger holding mechanism is not limited to the above-described structures. Other mechanisms, such as an air cylinder, may be used, so long as they can bring the bottom surface of the heat exchanger 20 into contact with upper surface of the polishing pad 13 and can press the heat exchanger 20 against the upper surface of the polishing pad 13 at a predetermined force.

Figure 8:
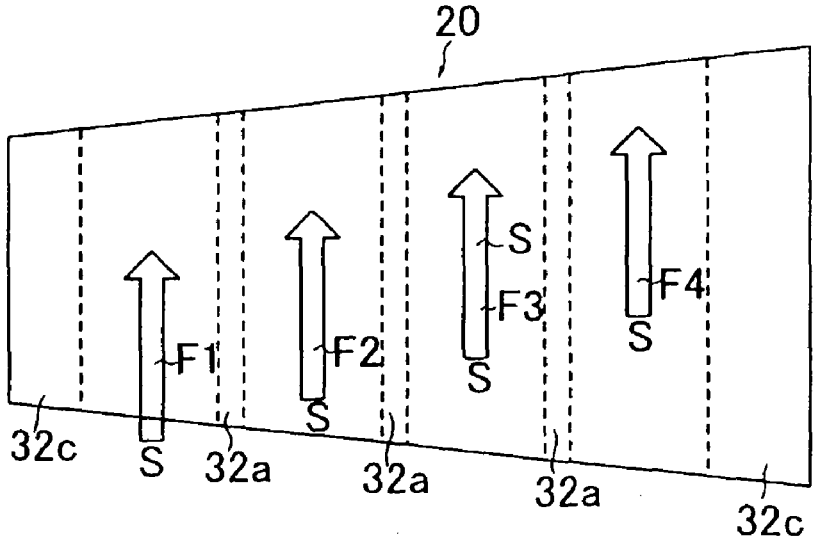
FIG. 8 is a bottom view of the heat exchanger for illustrating flow of slurry.

During polishing of the semiconductor wafer Wf (i.e., during rotation of the table 12), the lower end surfaces of the elongated protrusions 32*a* and the elongated protrusions 32*c* are in contact with the upper surface (polishing surface) of the polishing pad 13 at a predetermined force. The slurry (polishing liquid) S on the polishing surface of the rotating polishing pad 13 flows into the gap between the elongated protrusion 32*a* and the elongated protrusion 32*c* and into the gap between the elongated protrusion 32*a* and the elongated protrusion 32*a*, as indicated by arrows F1, F2, F3, and F4 in FIG. 8, whereby a lift is exerted on the heat exchanger 20 by a wedge action. When the lift is larger than the pressing force applied to the heat exchanger 20 by the support mechanism 41, the heat exchanger 20 is kept in non-contact with the polishing pad 13. In this non-contact state, there is no friction between the bottom plate 32 of the heat exchanger 20 and the polishing pad 13. Therefore, frictional heat is not produced and wear does not occur. Moreover, the elongated protrusions 32*c* and the elongated protrusions 32*a* prevent the slurry S from running away from the paths of the slurry S. Therefore, the heat exchanger 20 can maintain its stable attitude even in a non-contact state.

Even if a complete non-contact is not provided due to non-uniform flatness of the polishing pad 13 or due to grooves typically formed on the polishing surface of the polishing pad 13, the lift can greatly reduce the friction. As a result, less wear occurs, and hence an influence on the polishing process is reduced. Specifically, as shown in FIG. 7, when the elongated protrusions 32*a* and 32*c* on the lower surface of the bottom plate 32 are pressed in Z direction (a direction perpendicular to the polishing surface) at predetermined pressure, a value of (h1−h0)/h0 (see FIG. 6) can be kept constant, and the lift can thus be kept constant appropriately. Further, by appropriately adjusting a gap between the bearing 21*a* and the support pin 42 and a gap between the bearing 21*b* and the support pin 43, movement of the heat exchanger 20 in XY direction (a direction parallel with the polishing surface) can be regulated, whereby the bottom plate 32 becomes more stable. It is preferable that self-lubricating material (e.g., PTFE, lubricant-containing material) be used for the bearings 21*a* and 21*b*.

Heat exchange between the polishing surface of the polishing pad 13 and the cooling water flowing through the medium passage 33 of the heat exchanger 20 is performed via the bottom plate 32 and the slurry S that is present between the bottom plate 32 and the polishing surface of the polishing pad 13, so that the polishing surface is cooled. This heat exchange allows the temperature of the polishing surface to fall within a predetermined temperature range suitable for polishing of the semiconductor wafer Wf (e.g., not more than 45° C. in this embodiment). The bottom plate 32 that contributes to the heat exchange of the heat exchanger 20 is made from a high heat-conductive material, such as SiC. The gradient of the bottom surface 32*b* is such that the value of (h1−h0)/h0 is in the range of 1 to 2, wherein h1 is a height of a first side end of the bottom surface 32*b* from the lowermost end of the heat exchanger 20, and h0 is a height of a second side end of the bottom surface 32*b* from the lowermost end of the heat exchanger 20. In this definition, the first side end is located at an upstream side and the second side end is located at a downstream side with respect to the movement direction of the table 12 as indicated by arrow B in FIG. 6. As one example, h1 is 0.15 mm and h0 is 0.05 mm, and the bottom surface 32*b* is linearly inclined. The shape and dimensions are not limited to this embodiment. For example, the bottom surface 32*b* may be steps, other than the above-described linearly inclined surface.

SiC (silicon carbide) has a heat conductivity of 100 w/mk, which is three times higher than that of $Al_2O_3$ and five times higher than that of SUS. Therefore, use of SiC for at least the bottom plate 32 of the heat exchanger 20 can enhance the heat exchange performance. During polishing, a slurry layer is present between the bottom plate 32 and the polishing surface. Typically, the slurry has a relatively low heat conductivity of 0.63 w/mk. However, a thickness of this slurry layer is at most 0.15 mm, and an average thickness is about 0.1 mm. Therefore, the slurry layer does not greatly inhibit the heat conduction. These values are only examples, and the present invention is not limited to those values. The heat-exchange body 31 of the heat exchanger 20 is preferably made from a material which is easy to be processed, from a point of view of forming the medium passage 33 therein. The bottom plate 32 can be made from carbon with a surface thereof being coated with SiC, since carbon has a high heat conductivity and a low specific gravity. Use of such a material can provide the heat exchanger with high heat-exchange performance, excellent wear resistance, and lightweight.

In this embodiment, the heat exchanger 20 has an elongated trapezoid shape with the narrow front end and the wide rear end. The heat exchanger 20 is shaped in this form so as not to inhibit the slurry S, supplied from the polishing-liquid supply nozzle 23 onto the center of the polishing surface, from spreading radially (circularly) over the polishing surface via a centrifugal force created by the rotation of the polishing pad 13. Therefore, if the frond end of the heat exchanger 20 is not likely to inhibit the spread of the slurry S, the heat exchanger 20 may have a rectangular shape with a front end and a rear end each having an equal wide, as shown in FIGS. 9A through 9C.

Figure 9A:
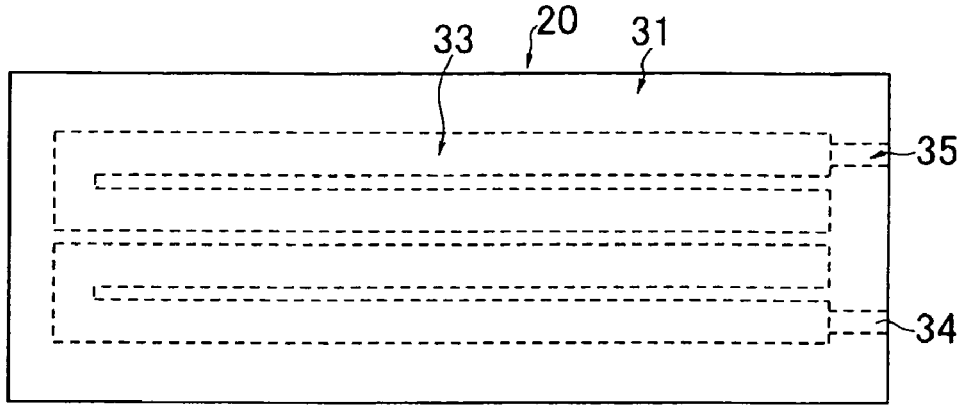
FIG. 9A is a plan view showing an appearance of another example of the heat exchanger.
Figure 9B:
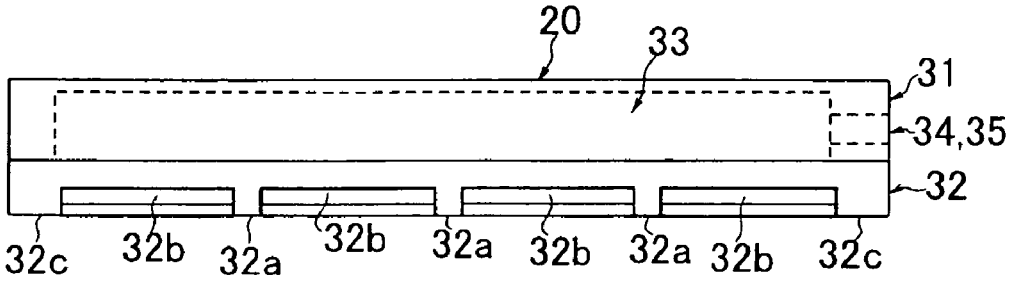
FIG. 9B is a front view showing the heat exchanger.
Figure 9C:
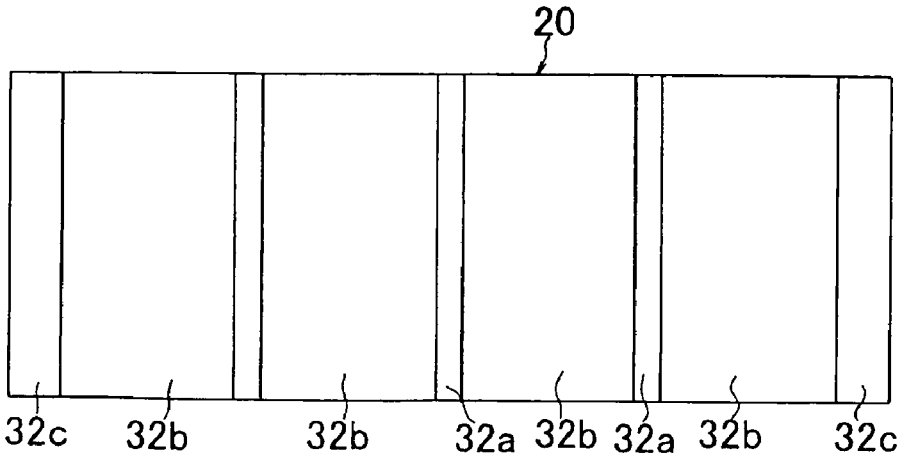
FIG. 9C is a bottom view showing the heat exchanger.

FIG. 9A is a plan view showing an appearance of another example of the heat exchanger, FIG. 9B is a front view showing the heat exchanger, and FIG. 9C is a bottom view showing the heat exchanger. In this example, heat-exchange body 31 is formed from a rectangular plate in which zigzag medium passage 33 is formed. Bottom plate 32 is also formed from a rectangular plate having elongated protrusions 32*c* and 32*c* on both sides of a bottom surface thereof Plural (three in the drawings) elongated protrusions 32*a* are arranged between the elongated protrusions 32*c* and 32*c*. Bottom surfaces 32*b* are formed between the elongated protrusions 32*c* and 32*a* and between the elongated protrusions 32*a* and 32*a*. These bottom surfaces 32*b* lie with an upward gradient at a predetermined angle above the polishing surface. Specifically, the bottom surfaces 32*b* are inclined upwardly along a direction opposite to the movement direction of the polishing surface (table 12).

Figure 10:
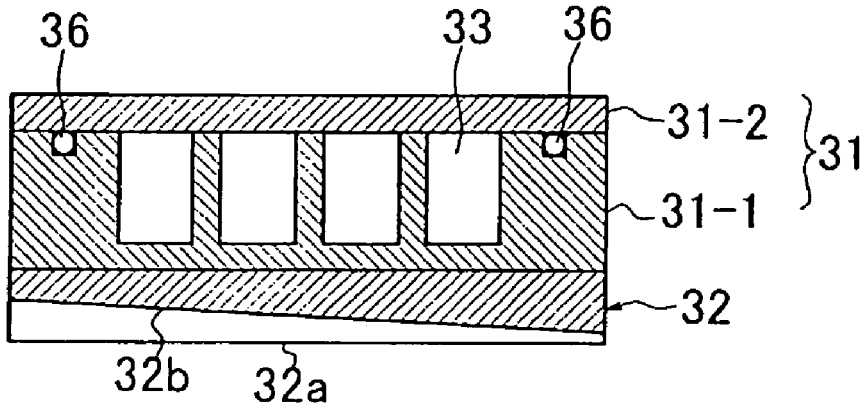
FIG. 10 is a cross-sectional view showing an internal structure of the heat exchanger.
Figure 11:
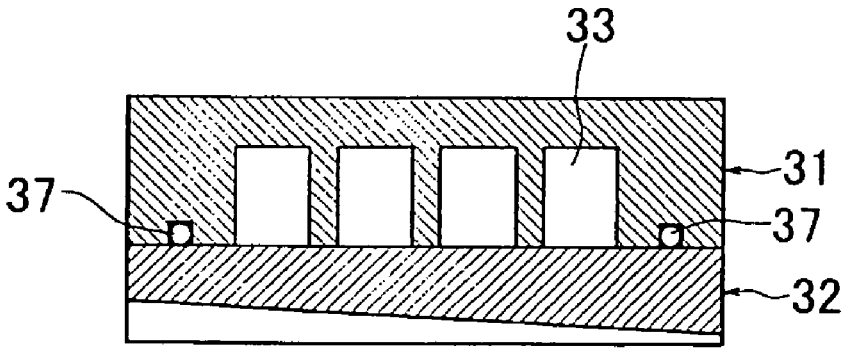
FIG. 11 is a cross-sectional view showing an internal structure of the heat exchanger.

As shown in FIG. 10, the heat exchanger 20 is divided into three sections. Specifically, the heat-exchange body 31 is divided into a passage-formation section 31-1 and a lid section 31-2. The passage-formation section 31-1 has a medium passage 33 therein, and the lid section 31-2 is shaped so as to close an opening of the medium passage 33. The bottom plate 32 is provided on a bottom surface of the passage-formation section 31-1. Alternatively, the heat exchanger 20 may be divided into two sections, as shown in FIG. 11. In this example, the heat exchanger 20 comprises passage-formation section 31 having medium passage 33 therein, and bottom plate 32 provided on a bottom surface of the passage-formation section 31. Reference numeral 36 is a seal member, such as O-ring, interposed between the passage-formation section 31-1 and the lid section 31-2. Reference numeral 37 is a seal member, such as O-ring, interposed between the passage-formation section 31 and the bottom plate 32.

Figure 12:
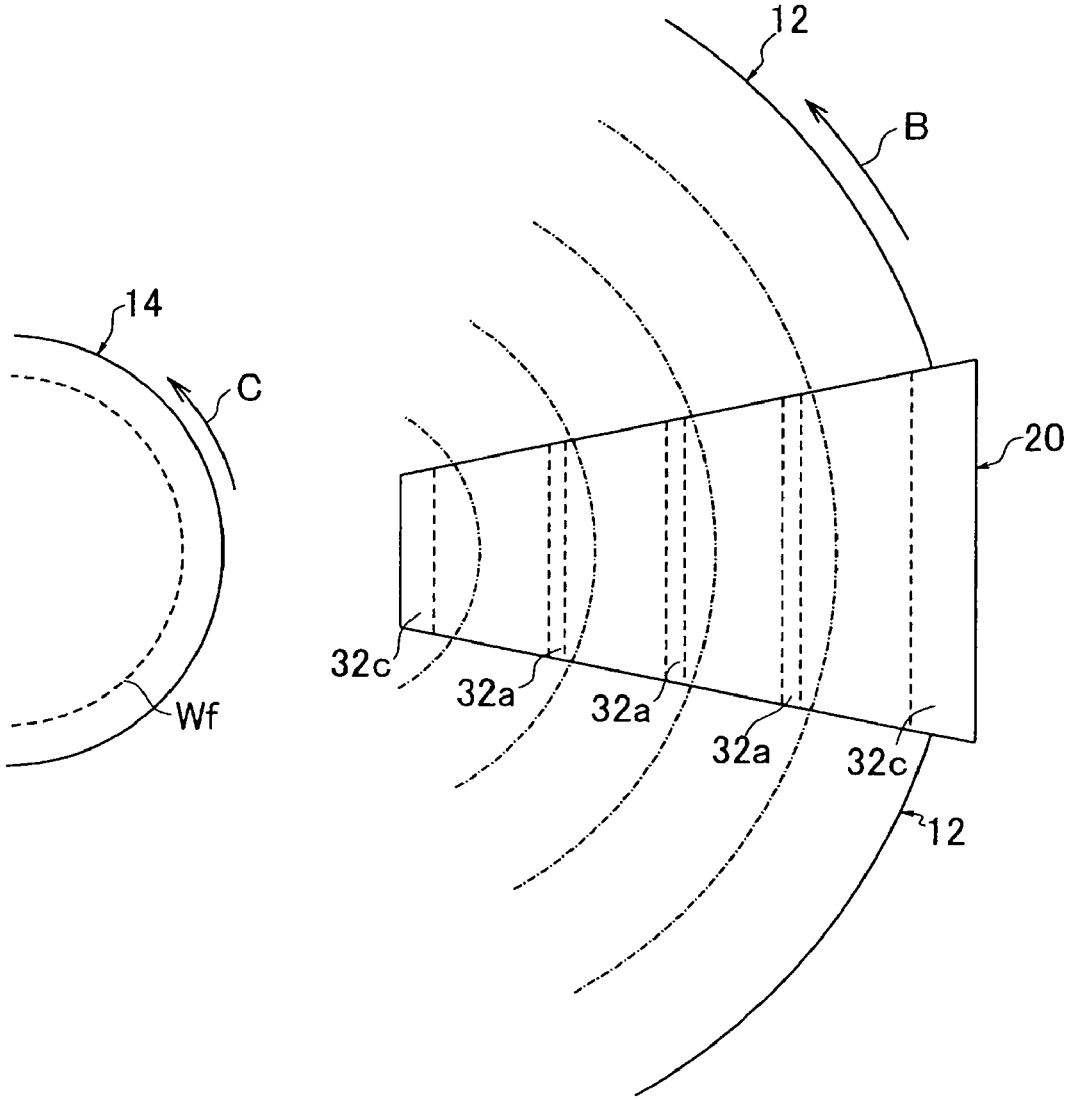
FIG. 12 is a plan view schematically showing the polishing apparatus with the apparatus for heating or cooling the polishing surface according to the embodiment of the present invention.
Figure 13:
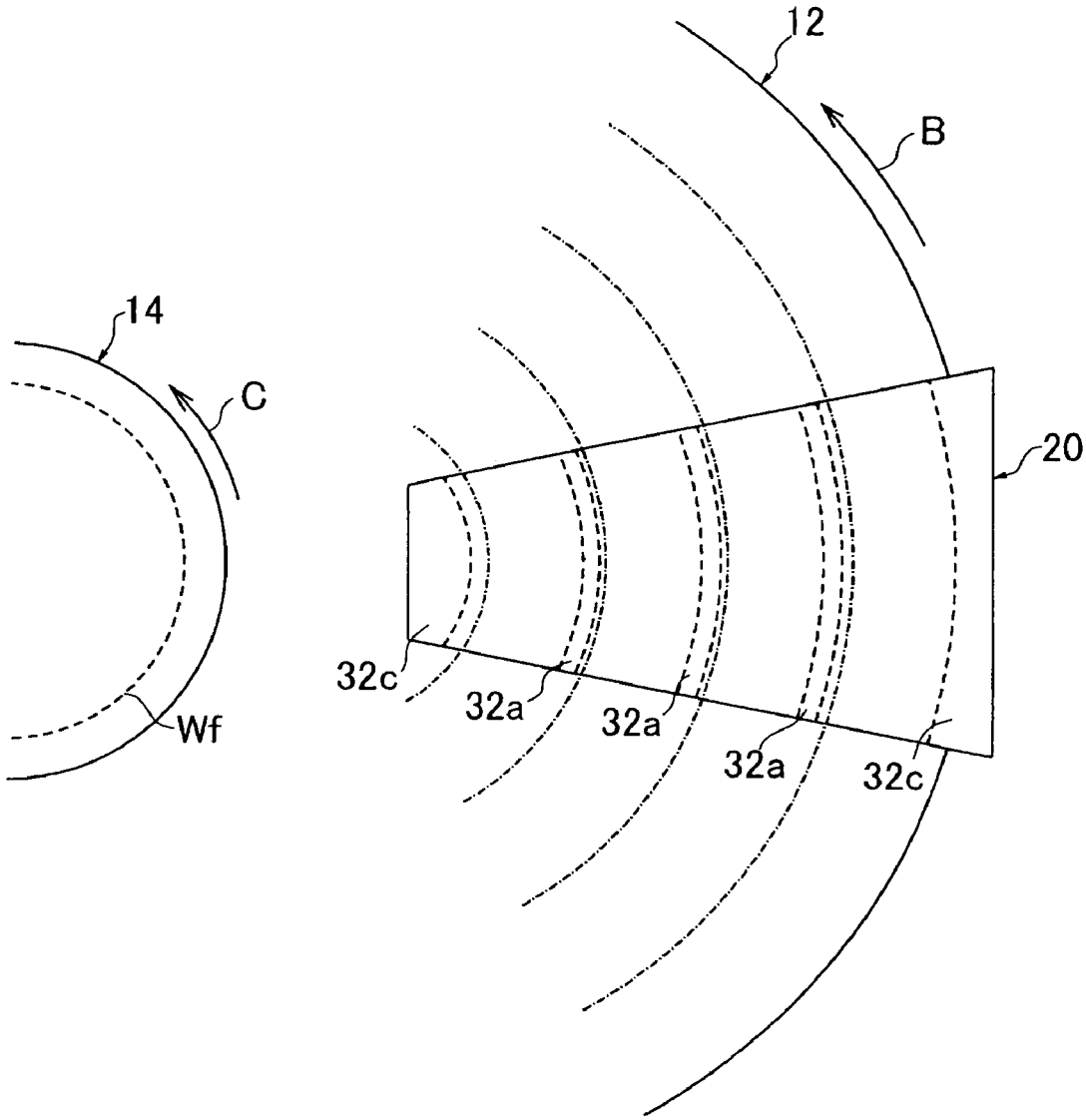
FIG. 13 is a plan view schematically showing the polishing apparatus with another example of the apparatus for heating or cooling the polishing surface according to the embodiment of the present invention.
Figure 14:
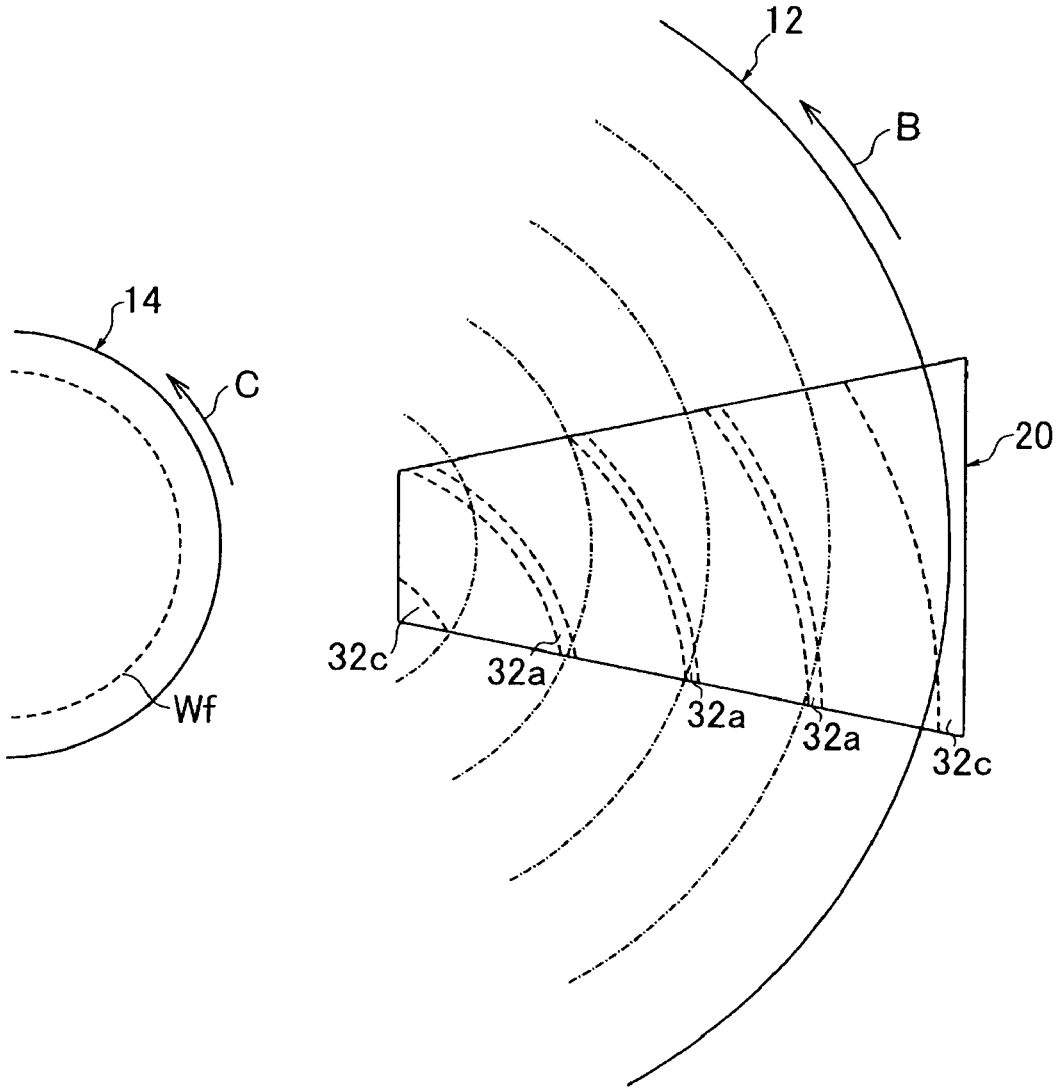
FIG. 14 is a plan view schematically showing the polishing apparatus with another example of the apparatus for heating or cooling the polishing surface according to the embodiment of the present invention.

In the above-described examples, the elongated protrusions 32*a* and 32*c* are arranged at equal intervals in parallel with a tangent direction of the rotating table 12, as shown in FIG. 12. However, as shown in FIG. 13, the elongated protrusions 32*a* and 32*c* may be shaped so as to extend along concentric circles having the same axis as the rotating table 12. With this arrangement, top portions of the elongated protrusions 32*a* and 32*c* are uniformly placed in contact with the polishing surface, and therefore, the polishing surface can have a larger area where the top portions of the elongated protrusions 32*a* and 32*c* do not contact. Further, as shown in FIG. 14, the elongated protrusions 32*a* and 32*c* may extend spirally. With this arrangement, damage to the polishing surface by the elongated protrusions 32*a* and 32*c* can be uniform. In this case, the swirling direction of the elongated protrusions 32*a* and 32*c* is such that the slurry S flows inwardly. With this configuration, the slurry (polishing liquid) is easily held on the polishing surface, and an amount of the slurry to be used can be reduced. Radiuses of the elongated protrusions 32*a* are not limited to specific values, so long as the elongated protrusions 32*a* extend in directions such that the slurry S flows radially inwardly. For example, plural arcs each having the same radius may be arranged, with their centers being deviated from each other.

Figure 17A:
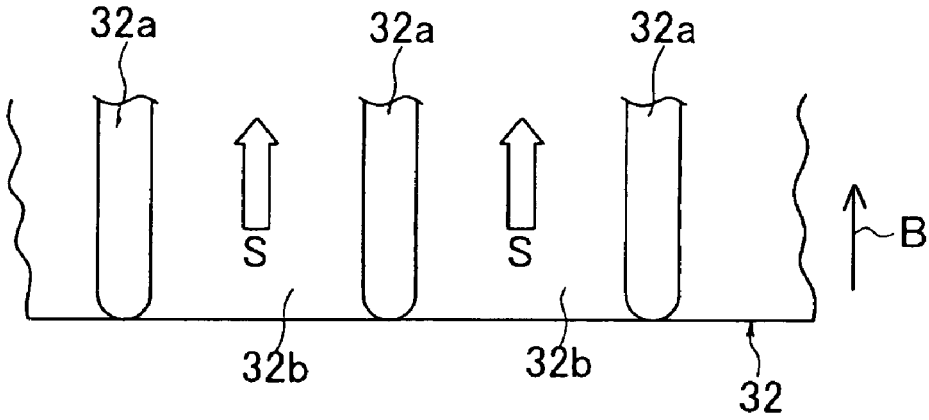
FIGS. 17A and 17B are bottom views each showing a part of the heat exchanger for illustrating the flow of the slurry.
Figure 17B:
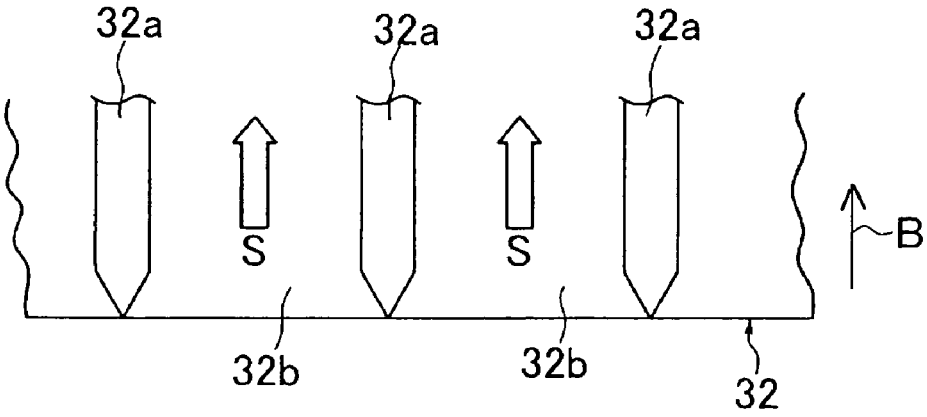

A tip end (a portion that counters the movement direction of the table 12 as indicated by arrow B) of the elongated protrusion 32*a* may have a semicircular horizontal cross section as shown in FIG. 17A or may have a triangular horizontal cross section as shown in FIG. 17B. With these configurations, it becomes easy for the slurry S to flow into the gap between the elongated protrusions 32*a* and 32*a*. As a result, a larger amount of slurry S flows into the gap to thereby accelerate the heat exchange and to increase an amount of slurry that contributes to polishing.

Figure 15:
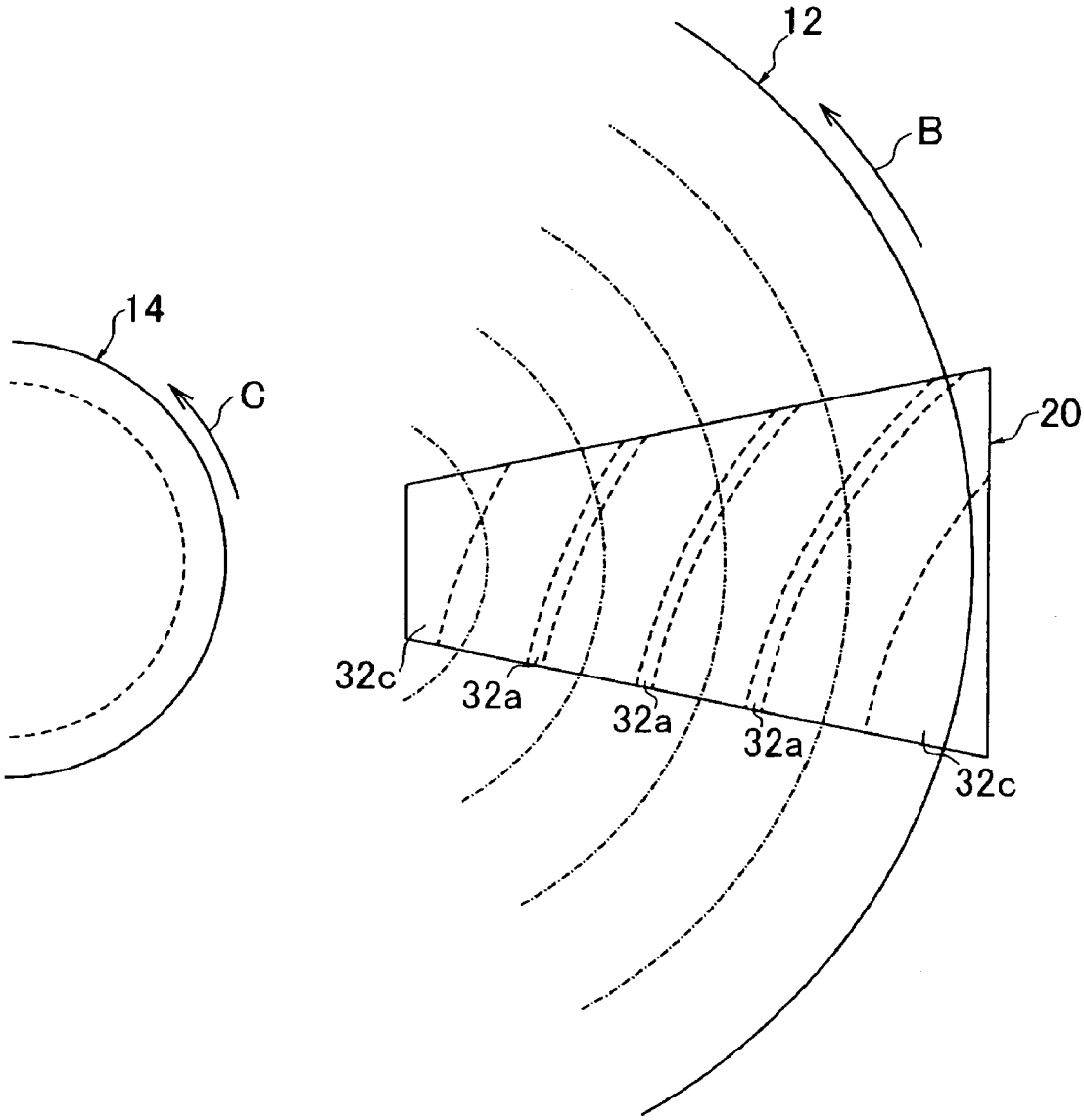
FIG. 15 is a plan view schematically showing the polishing apparatus with another example of the apparatus for heating or cooling the polishing surface according to the embodiment of the present invention.
Figure 16:
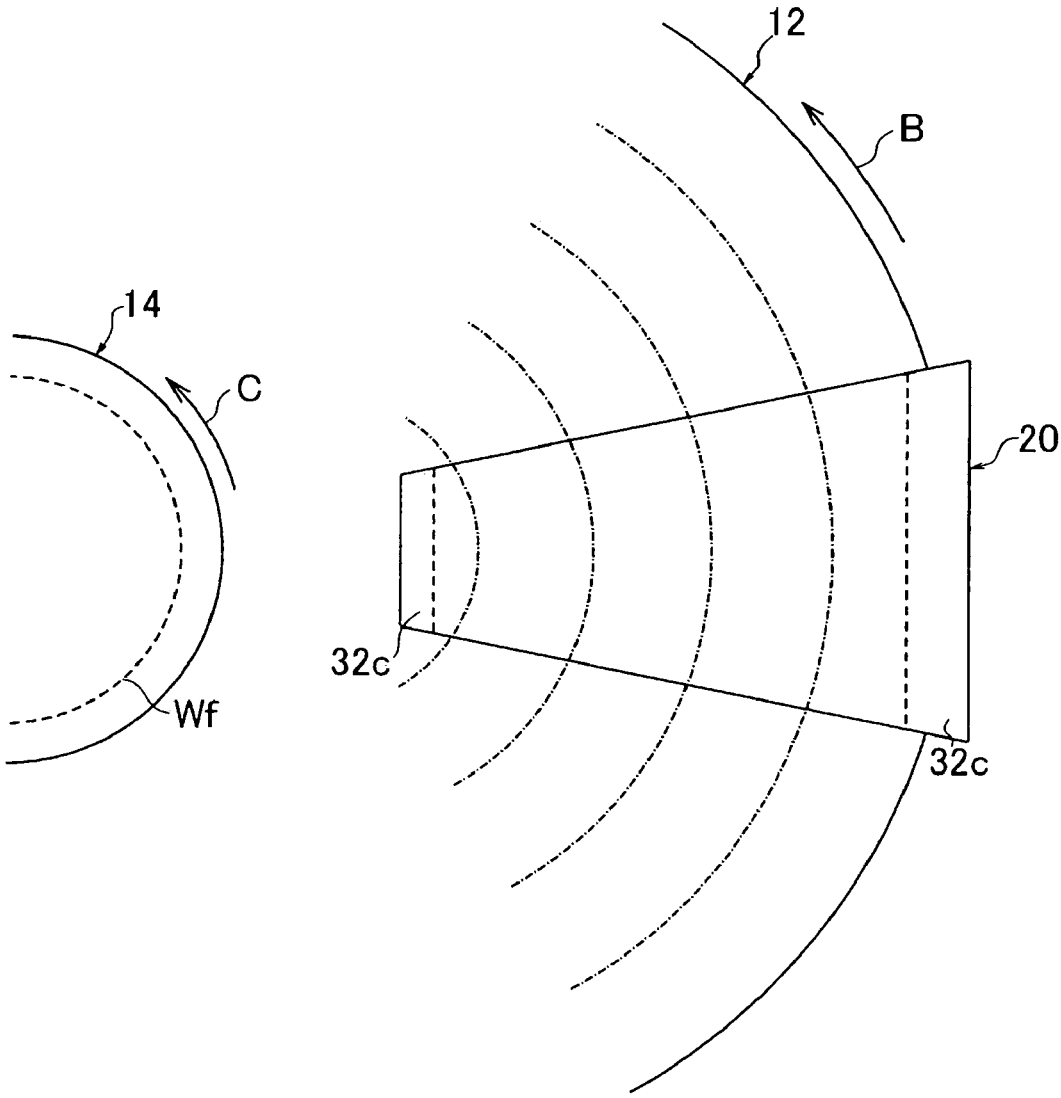
FIG. 16 is a plan view schematically showing the polishing apparatus with another example of the apparatus for heating or cooling the polishing surface according to the embodiment of the present invention.

As shown in FIG. 15, the elongated protrusions 32*a* and 32*c* may be arranged so as to extend in directions such that the slurry S flows out from the table 12 (polishing pad 13). With this arrangement, the slurry S used in polishing can be rapidly expelled from the table 12. Hence, scratches of the workpiece that could be caused by the slurry used in polishing can be reduced. As shown in FIG. 16, only the elongated protrusions 32*c* may be provided on both ends of the bottom surface of the bottom plate 32 of the heat exchanger 20. With this arrangement, the top portions of the elongated protrusions 32*c* are placed in contact with areas of the polishing surface where the semiconductor wafer Wf does not contact. Therefore, damages to the polishing surface can be prevented.

The aforementioned embodiment shows an example in which the polishing pad 13 is attached to the upper surface of the table 12. However, the present invention is not limited to this embodiment. For example, a fixed abrasive having a polishing surface can be attached to the table 12. In this case also, the heat exchanger 20 can cool the polishing surface that is heated by the frictional heat generated by polishing of the semiconductor wafer Wf.

The aforementioned embodiment also shows an example in which the cooling water is used as the heat-exchanging medium that flows through the medium passage 33. However, the present invention is not limited to this embodiment, and any type of heat-exchanging medium (liquid or gas) can be used. For example, a heat-exchanging medium which has been heated to a predetermined temperature may be used so that the temperature of the polishing surface can be adjusted to a suitable temperature in accordance with the types of workpiece and polishing conditions. In this manner, the present invention can provide an apparatus for heating or cooling the polishing surface.

Although the above-described embodiment uses the semiconductor wafer Wf as the workpiece to be polished, the workpiece is not limited to the semiconductor wafer. The workpiece may be various types of hard disk, a glass substrate, a liquid crystal panel, or the like. In this case, the polishing liquid is not limited to the slurry.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. An apparatus for heating or cooling a polishing surface of a polishing apparatus operable to polish a workpiece by sliding contact between the workpiece and the polishing surface while supplying a polishing liquid onto the polishing surface, said apparatus for heating or cooling the polishing surface comprising:

a heat exchanger arranged so as to face the polishing surface when the workpiece is polished, wherein said heat exchanger includes (i) a medium passage through which a heat-exchanging medium flows, and (ii) a bottom surface facing the polishing surface, at least a part of said bottom surface being inclined with an upward gradient above the polishing surface such that the polishing liquid, which is present between the polishing surface and said bottom surface, generates a lift exerted on said bottom surface during movement of the polishing surface.

2. The apparatus for heating or cooling the polishing surface according to claim 1, wherein said at least a part of said bottom surface comprises a linearly inclined surface.

3. The apparatus for heating or cooling the polishing surface according to claim 1, wherein said at least a part of said bottom surface comprises steps.

4. The apparatus for heating or cooling the polishing surface according to claim 1, wherein said heat exchanger is operable to perform heat exchange between the polishing surface and the heat-exchanging medium flowing through said medium passage, during polishing of the workpiece.

5. The apparatus for heating or cooling the polishing surface according to claim 1, wherein said heat exchanger further includes plural elongated protrusions arranged on said bottom surface at predetermined intervals, said elongated protrusions forming a path therebetween for the polishing liquid.

6. The apparatus for heating or cooling the polishing surface according to claim 1, further comprising:

a heat-exchanger holding mechanism having a pressing mechanism configured to press said heat exchanger against the polishing surface.

7. The apparatus for heating or cooling the polishing surface according to claim 1, wherein said heat exchanger is made from SiC.

8. The apparatus for heating or cooling the polishing surface according to claim 1, wherein the heat-exchange medium comprises cooling water.

* * * * *